US006435341B1

(12) United States Patent
Nobbio

(10) Patent No.: US 6,435,341 B1
(45) Date of Patent: Aug. 20, 2002

(54) CHILD PROOF SEALING DEVICE FOR A CONTAINER OF SUBSTANCES TO BE KEPT SEPARATE UP TO THEIR DISPENSING

(75) Inventor: Alessio Nobbio, Milan (IT)

(73) Assignee: Inge S.p.A., Garbagnate Milanese (IT)

( * ) Notice: Subject to any disclaimer, the term of this patent is extended or adjusted under 35 U.S.C. 154(b) by 26 days.

(21) Appl. No.: 09/653,775

(22) Filed: Sep. 1, 2000

(51) Int. Cl.[7] ..... B65D 25/08
(52) U.S. Cl. ..... 206/219; 206/221
(58) Field of Search ..... 206/219, 221; 215/220

(56) References Cited

U.S. PATENT DOCUMENTS 4,286,633 A * 9/1981 Herr ..... 215/220
4,474,301 A * 10/1984 Davis ..... 215/220
5,542,528 A * 8/1996 Lanfranconi et al. ..... 206/221
5,782,345 A * 7/1998 Guasch et al. ..... 206/222
6,170,654 B1 * 1/2001 Gartner et al. ..... 206/219

* cited by examiner

*Primary Examiner*—David T. Fidei
(74) *Attorney, Agent, or Firm*—Hedman & Costigan, P.C.

(57) ABSTRACT

A sealing device (12) for a container (14) of substances to be kept separate up to their dispensing comprises an inner cap (20) and an outer cap (40) inserted idly on the inner cap (20). The inner cap (20) offers a cavity which forms a chamber (22) capable of containing a product. The chamber (22) is sealed by a sealing element (42) controlled at the opening time, so that the opening of the chamber (22) causes a product contained in the chamber (22) to be mixed with a second product contained in the same container (14), where said inner cap (20) is fitted with an internally threaded element (30) capable of coupling with a corresponding threaded portion (18) of the container (14) and of engaging with the outer cap (40) by some male-female elements (36, 38) arranged on the inner cap (20) and on the outer cap (40).

3 Claims, 3 Drawing Sheets

CHILD PROOF SEALING DEVICE FOR A CONTAINER OF SUBSTANCES TO BE KEPT SEPARATE UP TO THEIR DISPENSING

BACKGROUND OF THE INVENTION

This invention refers to a sealing device for a container of substances to be kept separate up to their dispensing.

There are presently containers on the market which allow keeping the substances they contain in a separate form up to their moment of usage, when they are mixed. This need often arises whenever some pharmaceutical materials are to be preserved, which would quickly lose their therapeutic effect if offered for sale in an already pre-mixed and ready-to-use form.

Such containers are usually equipped with a sealing device based on a hollow cap with a yielding extremity protruding from the container. This extremity can be pressed to allow a mushroom-shaped element to slide by gravity from a sealing position to an opening position of a chamber within the cap itself. The opening of the inner chamber releases the product contained in the same, so as to form the desired mixture.

The hollow cap is usually connected to the container by a threaded coupling, so as to allow opening the containers to use the product in the same, after the mixture has formed.

Other containers are known to be equipped with a sealing device designed to prevent its opening by a child, conventionally known as "child-proof". These containers are fitted with two caps, where an inner cap actually seals the container and is inserted inside an outer cap, on which a user may act to open the container. The two caps can be coupled by some male-female elements provided on the accessible portions of each cap, so that if the outer cap is turned to open the container, the latter turns idly on the inner cap, while if the outer cap is pressed and rotated with respect to the inner cap, the male-female elements are coupled to allow opening the container.

The conventional sealing devices for containers of substances to be kept separate until dispensing are not produced with a child-proof sealing device. This implies that a child may by a playful accident form the mixture and subsequently drink it, with some unpleasant consequences.

It should also be added that the sealing devices for containers of substances to be kept separate until dispensing present the yielding extremity of the cap, which is capable of being pressed to generate a mixture, in a freely accessible form, unprotected by safety devices to prevent it from being pressed in an accidental manner. Such a circumstance could in fact occur where several containers happen to be piled one on top of the other with the bottom of one resting on the cap of the other, or where other objects may accidentally happen to press on the yielding extremity of the caps.

The purpose of this invention is to eliminate the mentioned drawbacks, by producing a sealing device for a container of substances to be kept separate until dispensing, capable of implementing both the function of separating the products to be mixed as well as the function of providing a child-proof seal.

A further purpose of the invention is to produce a sealing device for a container of substances to be kept separate until dispensing, capable of preventing the formation of the mixture as a result of some accidental events.

Not the last purpose of the invention is to create a sealing device for a container of substances to be kept separate until dispensing which is essentially simple, safe and reliable.

SUMMARY OF THE INVENTION

These and other purposes according to this invention, are achieved by producing a sealing device for a container of substances to be kept separate until dispensing. The sealing device of the invention comprises at least one inner cap and an outer cap inserted on said inner cap, wherein said inner cap has a cavity forming a chamber capable of containing a first product and said chamber is sealed by a sealing element, said chamber having a controlled opening which allows said first product contained in said chamber and a second product held in said container to form a mixture; said inner cap having at least one internally threaded element for coupling with a corresponding threaded portion of said container and for engaging with said outer cap by male-female elements which are arranged on said inner cap and on said outer cap, said inner cap being rotatable by exerting as force which acts on said outer cap to open container. Other characteristics and advantages of the sealing device according to this invention are defined in the subsequent claims.

The sealing device according to the invention may advantageously be mounted on containers of any shape or material; the device may further be utilized to mix both liquid and powdered products. However, the product held in the container is usually liquid, while that contained in the sealing device is a powder.

The characteristics and advantages of a sealing device for a container of substances to be kept separate until dispensing according to this invention will become more clearly evident from the description that follows, offered for exemplifying and non-limiting purposes and with reference to the simplified attached drawings, in which:

Figure 1:
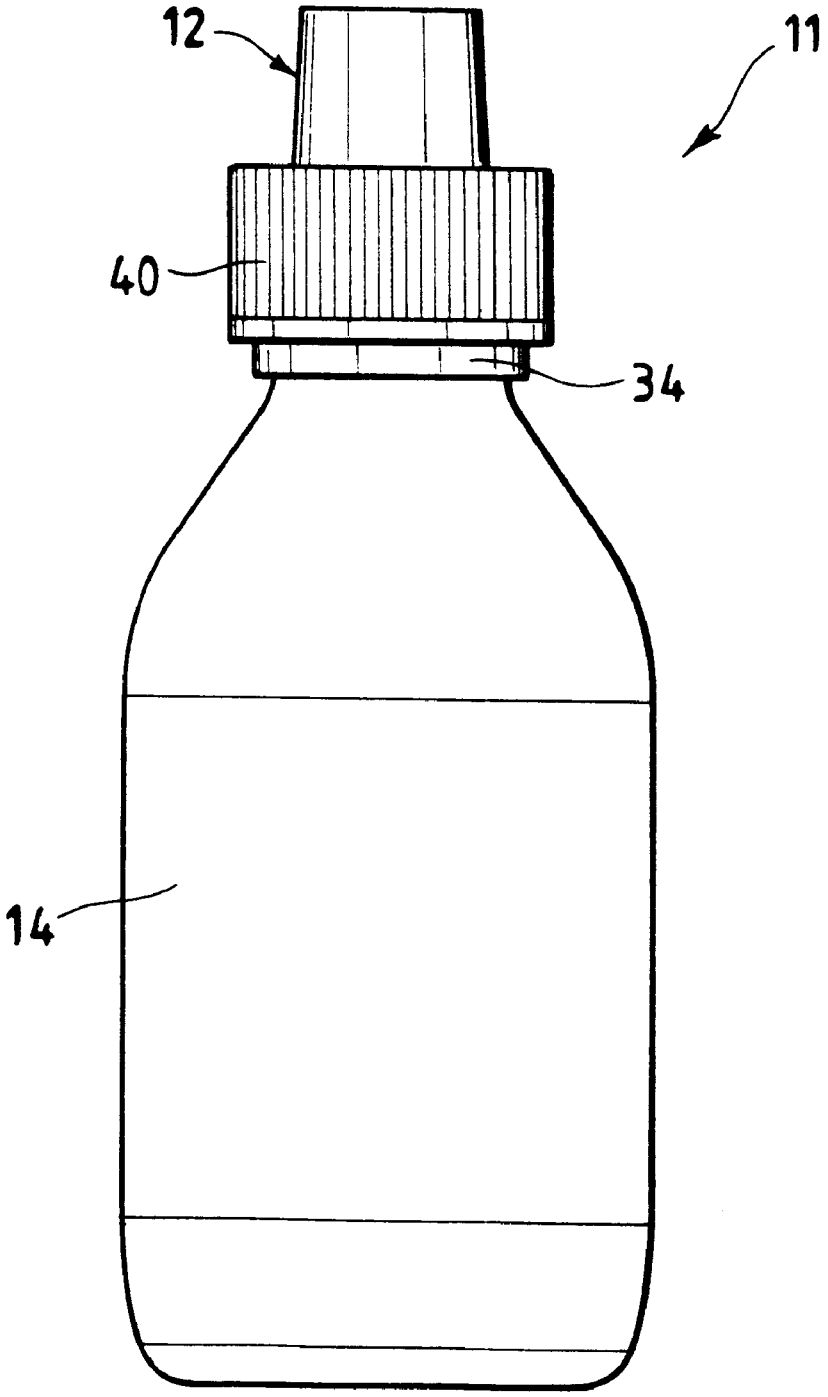
FIG. 1 shows a view of a container equipped with a sealing device according to this invention.

The mentioned figures show a sealing device 12 for a container 14 of substances to be kept separate until dispensing, indicated in its overall form by the reference number 11.

DETAILED DESCRIPTION OF THE INVENTION

The container 14 is constituted of a bottle having a neck fitted with an annular enlargement 16 and a portion 18 turned toward the threaded free end.

The portion 18 can be coupled to the sealing device 12 according to this invention.

The sealing device 12 comprises an inner cap 20 fitted with a cavity opening toward the interior of the container 14 when the latter is sealed by the device 12, which forms a chamber 22. The inner cap 20 is essentially profiled like a sleeve and has an extremity sealed by a yielding cup-type portion 24. The cup 24 presents, at a point corresponding to the axis of symmetry of the sealing device 12, a projection 26 toward the interior of the chamber 22, which corresponds on the opposite side to a hollow capable of favoring a compression of the cup 24 by a finger.

Along the sides the cup 24 is surrounded by a protruding protective edge 28, constituted by an extension of the inner sleeve-type cap 20.

The opposite extremity of the inner cap 20 is firmly and concentrically, being made of a single piece, attached to a second sleeve-like element 30, connected to the sleeve-like cap 20 by a flat annular portion 32.

The extremity of the cap 20 and of the element 30 form between them an annular cavity into which the neck of the bottle 14 can be inserted. The element 30 is internally threaded for this purpose so as to be coupled with the threaded portion 18 of the neck of the bottle, and offers at its free extremity a smooth portion which can be coupled with the annular enlargement 16.

The free extremity of the element 30 is firmly attached, by elements with a predetermined rupture point, to a small collar 34 blocked against the enlarged portion 16.

The periphery of the flat annular portion 32 provides some profiled hollows 36 to fit some corresponding teeth 38 profiled and arranged so as to face the hollows 36. The teeth 38 are firmly attached to an outer cap 40 inserted idly on the inner cap 20. The hollows 36 and the corresponding teeth 38 constitute some male-female elements for blocking the inner cap 20 with respect to the outer cap 40.

The hollows 36 are in themselves known and therefore not shown. In a typical embodiment, each hollow 36 has a first squared wall and a second wall with a squared and a tilted portion, while the teeth 38 have both walls of a squared form. A rotation of the outer cap 40 with respect to the inner cap 20 holding the teeth 38 against the squared wall with the hollows 36 thus generates an interference and consequently seals the cap 20 on the container 14, even if only a slight pressure of the outer cap 40 is exerted against the inner cap 20. If on the other hand the container 14 is to be opened, the outer cap 40 must be rotated with respect to the inner cap 20 while holding the teeth 38 against the squared and tilted portions of the hollows 36 in order to open the container 14. This requires a pressure of the outer cap 40 applied against the inner cap 20 which is substantially higher than in the previous case.

The chamber 22 inside the inner cap 20 can be sealed by a mushroom-type sealing element 42. The sealing element 42 can be controlled to open by acting on the yielding cup 24, so that the opening of the chamber 22 creates the mixture between the product held in the chamber 22 and a second product held in the container 14. The element 42 is constituted by a sealing wall 44 produced in a single piece with a rod 46 set along one of its axes of symmetry. The rod 46 carries four ribs 48, whose extremities are firmly attached to a ring 50 whose size fits the cavity forming the chamber 22.

Inside and next to one of its extremities, the chamber 22 provides a first protruding rim 52, which engages with the periphery of the wall 44 to keep the mushroom-type element 42 in a sealed position. Next to this and more deeply in its interior, the chamber 22 provides a second protruding rim 54 which happens to be more pronounced than the rim 52. The rim 54 can block the ring 50 and thereby the mushroom-type element 42 whenever the chamber 22 is opened, thus preventing the container 14 from falling toward the interior.

Figure 3:
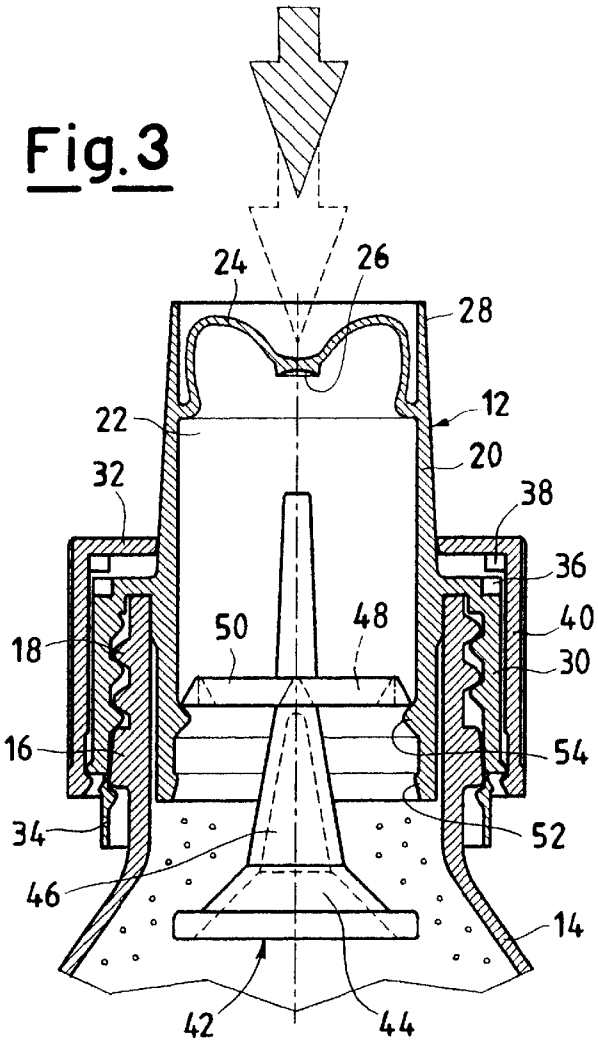
FIG. 3 shows a cross section of the sealing device of FIG. 2, where the chamber of the device is communicating with the interior of the container.
Figure 2:
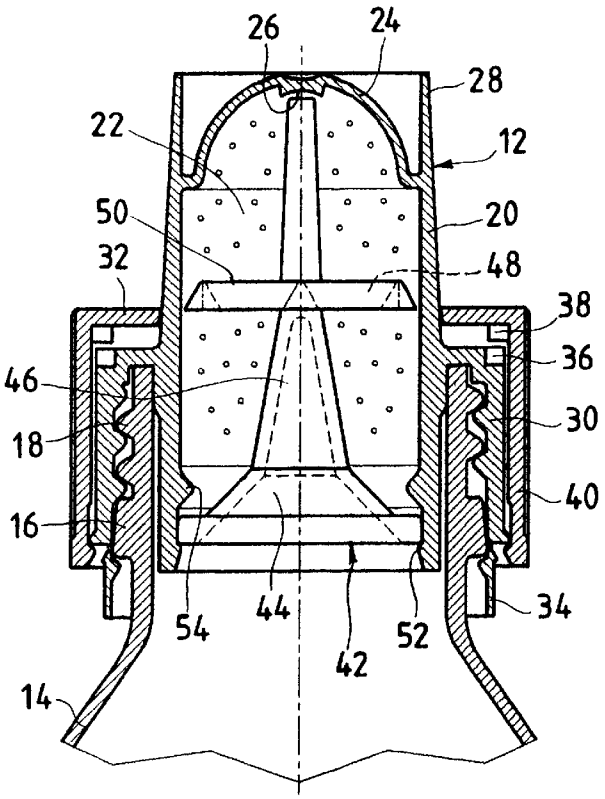
FIG. 2 shows a cross-section of the sealing device according to the invention, where a chamber of the device is separated from the interior of the container.
Figure 4:
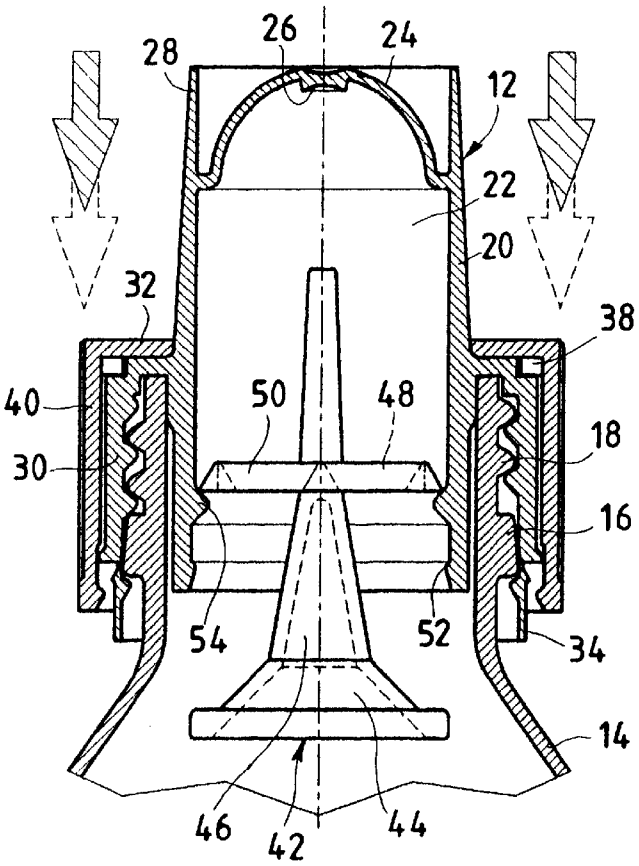
FIG. 4 shows a cross section of the sealing device of FIG. 2 where, while the chamber of the device is communicating with the interior of the container, a cap is pressed to allow the opening of the same container.

The operation of a sealing device for a container of substances to be kept separate up to their dispensing according to this invention is essentially as follows:

The yielding cup 24 (see FIG. 3) is pressed so that the projection 26 impinges on the free extremity of the rod 46 through the projection 26. While disengaging the wall 44 from the rim 52, the latter opens up the chamber 22 by gravity, thus pushing the ring 50 against the rim 54. This causes the product in the chamber 22 to be released and mixed with the product inside the container 14. The outer cap 40 (see FIG. 4) is then pressed against the inner cap 20, so as to engage the teeth 38 with the hollows 36.

Figure 5:
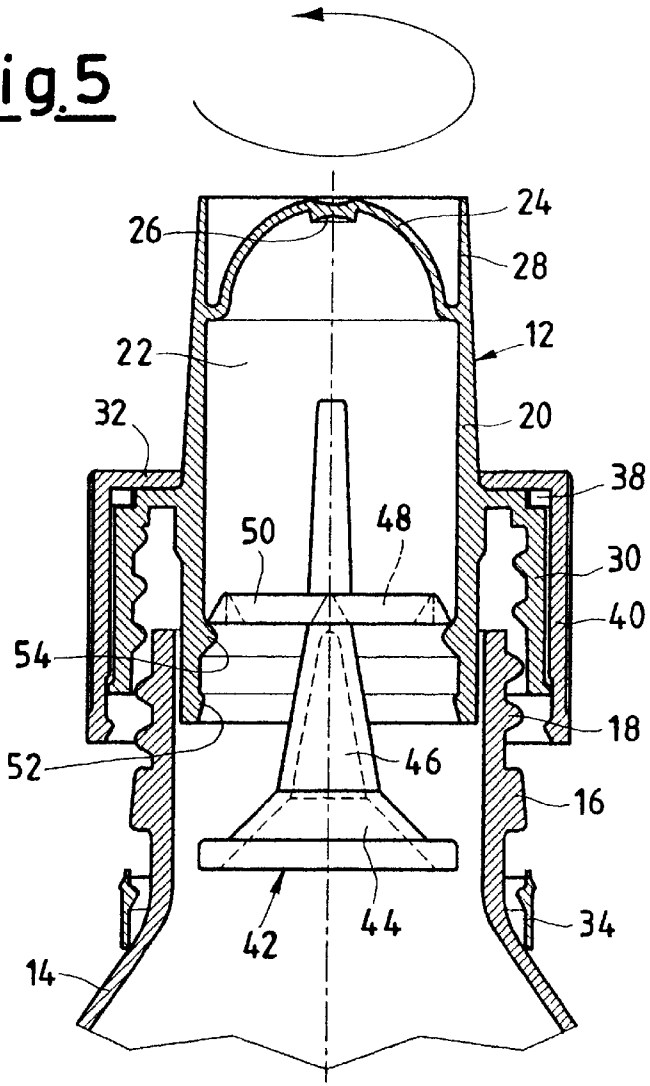
FIG. 5 shows a cross section of the sealing device of FIG. 4 where, while the chamber of the device is communicating with the interior of the container, the cap is turned so as to open the same container.

The outer cap 40 (see FIG. 5) and along with it, thanks to the coupling of the teeth 38 in the hollows 36, the inner cap 20 is then rotated so as to cause the opening of the container 14 and to make available the mixture contained therein.

It has in practice been shown that the sealing device for substances to be kept separate up to their dispensing according to this invention happens to be particularly advantageous because it is extremely safe and reliable. In practice, the materials and sizes utilized may be of any kind, depending on the technical requirements.

What is claimed is:

1. A sealing device (12) for a container (14) of substances to be kept separate until their dispensing, said sealing device comprising at least one inner cap (20) and an outer cap (40) inserted on said inner cap (20) wherein said inner cap (20) has a cavity forming a chamber (22) capable of containing a first product and said chamber (22) is sealed by a sealing element (42), said chamber (22) having a controlled opening, which allows said first product contained in said chamber (22) and a second product held in said container (14) to form a mixture; said inner cap (20) having at least one internally threaded element (30) for coupling with a corresponding threaded portion (18) of said container (14) and for engaging with said outer cap (40) by male-female elements (36, 38) which are arranged on said inner cap (20) and on said outer cap (40), said inner cap (20) being rotatable by exerting a force which acts on said outer cap (40) to open container (14); said inner cap (20) having an essentially sleeve-type profile that seals a first extremity by a yielding portion (24), wherein said yielding portion (24) controls the opening of said sealing element (42); said yielding portion (24) being essentially profiled in the form of a cup; said cup-type portion (24) being surrounded by a protruding protective rim (28).

2. A sealing device (12) according to claim 1 wherein a second extremity of said inner cap (20) is firmly attached to and concentric with said internally threaded sleeve-type element (30) which is connected to said inner sleeve-type cap (20) by at least one flat annular portion (32), so that the space between said extremity of said inner cap (20) and said internally threaded element (30) forms an annular cavity into which the neck of said container (14) can be inserted.

3. A sealing device (12) according to claim 2, where male-female elements (36, 38) are constituted by profiled hollows (36) provided along a periphery of said flat annular portion (32) so as to allow the insertion of corresponding profiled teeth (38) which are firmly attached to said outer cap (40) and are oriented to face said hollows (36).

* * * * *